United States Patent [19]

Beauchamp et al.

[11] 4,260,321

[45] Apr. 7, 1981

[54] LOCK MECHANISM FOR SECURING A BACKHOE BOOM AND SWING FRAME FOR TRANSPORT

[75] Inventors: Lynn I. Beauchamp; LeRoy E. Kraske, both of Dubuque, Iowa

[73] Assignee: Deere & Company, Moline, Ill.

[21] Appl. No.: 71,960

[22] Filed: Sep. 4, 1979

[51] Int. Cl.[3] ..... E02F 3/32

[52] U.S. Cl. ..... 414/694; 414/722; 212/229

[58] Field of Search ..... 414/694, 722, 685, 686, 414/687, 694; 182/15, 17; 248/654; 292/213, 218; 172/272; 212/227, 229, 245, 255, 182, 3, 8

[56] References Cited

U.S. PATENT DOCUMENTS

| | | | |
|---|---|---|---|
| 3,734,320 | 5/1973 | Redenbarger | 414/694 |
| 3,811,582 | 5/1974 | Shumaker | 414/694 |
| 3,921,835 | 11/1975 | Baker | 414/694 |
| 3,921,835 | 11/1975 | Baker | 414/694 |
| 3,951,281 | 4/1976 | Parquet | 212/189 |
| 4,184,803 | 1/1980 | Housman | 414/694 |
| 4,201,509 | 5/1980 | Hansen | 414/694 |

OTHER PUBLICATIONS

Photograph of Ford Backhoe Boom Lock.

*Primary Examiner*—Stephen G. Kunin
*Assistant Examiner*—Terrance L. Siemens

[57] ABSTRACT

A backhoe swing frame has a latch member fulcrumed to the top thereof. When the backhoe boom is in a raised transport position and the swing frame is in a centered position, the latch member may be pivoted to a lock position wherein a pin at one end thereof is received in a downwardly opening hook fixed to the backhoe boom and a block at the other end thereof is received in an upwardly opening channel at the top of the support frame for the swing frame.

7 Claims, 2 Drawing Figures

LOCK MECHANISM FOR SECURING A BACKHOE BOOM AND SWING FRAME FOR TRANSPORT

The present invention relates to tractor-mounted backhoes and more specifically relates to lock mechanisms for securing the backhoe swing frame and boom in place for transport.

Recently, a lock mechanism has been designed for remote actuation for simultaneously securing a backhoe swing frame and boom in place for transport. This lock mechanism includes a lock member fulcrumed on the swing frame and adapted to be pivoted to a lock position wherein a hook structure at its rear end engages a pin structure fixed to the backhoe boom and wherein a forward end thereof is disposed between a pair of stop blocks fixed to the backhoe support frame.

This known lock mechanism is not entirely satisfactory since any forces tending to pivot the swing frame when the lock member is in its lock position will tend to bend the member at its fulcrum. Further, no provision is made to accommodate for misfits or wear between the interlocking members of the mechanism.

SUMMARY OF THE INVENTION

According to the present invention, there is provided a novel lock mechanism for securing a backhoe swing frame and boom in place for transport.

A broad object of the invention is to provide a backhoe lock mechanism, which is of a simple and reliable construction that permits relatively large manufacturing tolerances.

Another object of the invention is to provide a lock mechanism which is width-wise compact.

Yet another object of the invention is to provide a lock mechanism having a lock member including a replaceable lock bar at one end and a replaceable lock pin at its other end, the lock pin being secured to the remainder of the lock member by a threaded connection by which the lock member is length-adjustable.

These and other objects will become apparent from a reading of the ensuing description, together with the appended drawing.

DESCRIPTION OF THE PREFERRED EMBODIMENT

Figure 1:
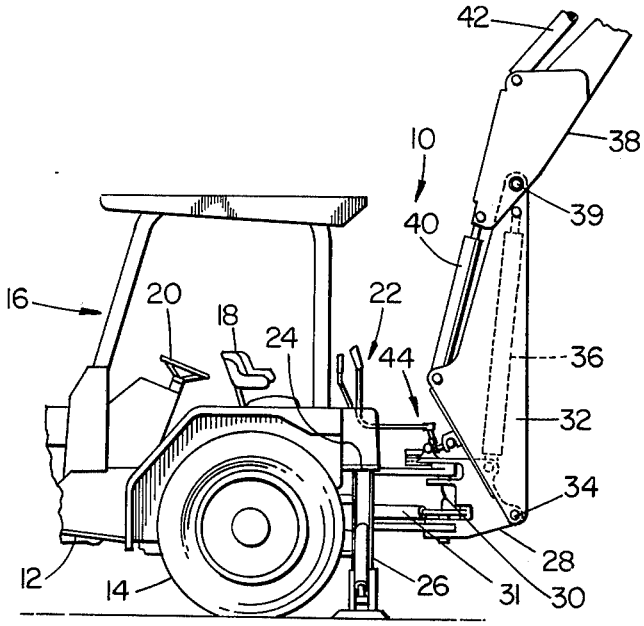
FIG. 1 is a left side elevational view of a tractor-backhoe embodying a boom swing and transport lock mechanism constructed in accordance with the present invention.

Referring now to FIG. 1, therein is shown a tractor-backhoe 10 comprising a tractor 12 including a pair of driven rear ground wheels 14 and an operator's station 16 located between the wheels. Located at the station 16 is a turnaround seat 18 located rearwardly of a steering wheel 20 and forwardly of backhoe controls 22.

The controls 22 are mounted on a support frame 24 which is attached to the rear end of the tractor 12. Mounted to opposite sides of the frame 24 are vertically swingable stablizer legs 26 (only one shown). A backhoe swing frame 28 is horizontally swingably connected to the frame 24 by means of a vertical pivot assembly 30.

A pair of hydraulic swing actuators 31 (only one shown) are connected between the frames 24 and 28 for selectively effecting relative pivotal movement therebetween. A generally triangular backhoe boom 32 is vertically pivotally connected to the swing frame 28 as at a pivot pin 34 and connected between the frame 28 and the boom 32 is a hydraulic boom actuator 36 which is operable to pivot the boom between an extreme raised or transport position, as shown, and various working positions. A dipperstick 38 is vertically pivotally connected to an end of the boom 32, as at a pin 39 and a hydraulic dipperstick actuator 40 is connected between the boom 32 and dipperstick 38 for selectively effecting articulation therebetween. A bucket, not shown, is vertically pivotally connected to the outer end of the dipperstick and provided for adjusting the bucket relative to the dipperstick is a powered linkage including a hydraulic bucket actuator 42.

Provided for selectively simultaneously locking the boom 32 in its raised transport position and the swing frame 28 in a centered position wherein it disposes the backhoe boom 32 centrally behind the tractor 12 is a lock mechanism 44.

Figure 2:
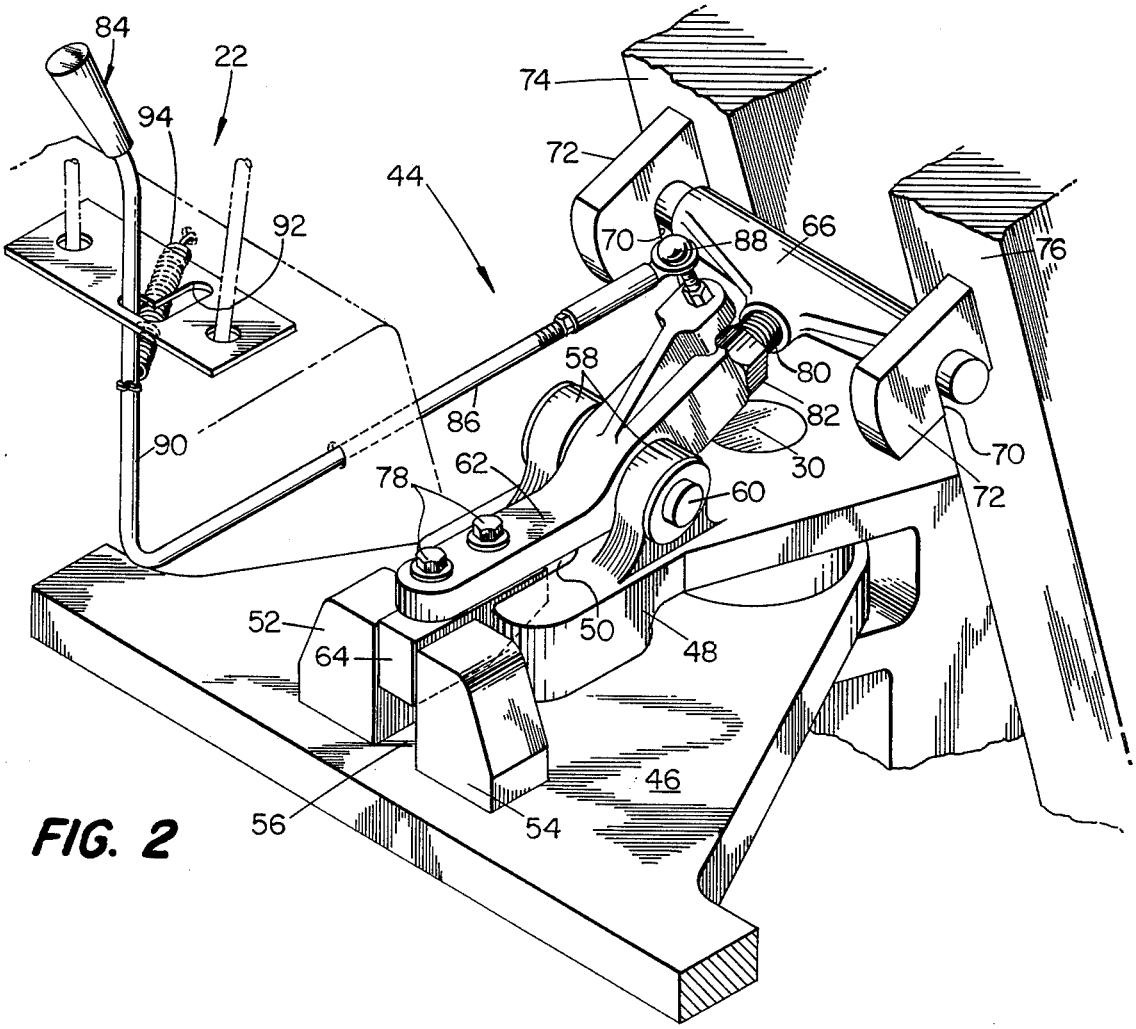
FIG. 2 is a left front perspective view of the lock mechanism showing the latch member in its locking position.

The lock mechanism 44 is shown in detail in FIG. 2 wherein it can be seen that the support frame 24 includes an upper, generally triangular horizontal plate 46 extending beneath a forwardly projecting, upper, horizontal plate 48 of the swing frame 28. The plate 48 extends forwardly beyond the pivot assembly 30 and has a rearwardly extending notch 50 formed in the forward end thereof. Fixed to the top surface of the plate 46 are right and left stop blocks 52 and 54 which define a channel 56 disposed in fore-and-aft alignment with the notch 50. A pair of spaced lugs or ears 58 are fixed to the top of the plate 48 and received between the lugs 58 and vertically pivotally connected thereto by means of a pivot pin 60 is an elongate latch member 62. The latch member 62 has a locking block 64 at its forward end received between the blocks 52 and 54 and in the notch 50 and has a cross pin 66 at its rear end received in downwardly opening notches 70 respectively formed in a pair of ears 72, fixed to laterally spaced members 74 and 76 of the boom such as to form a hook structure. The locking block 64 is releasably secured to the remainder of the latch member 62 by a pair of vertical cap screws 78 while the cross pin 66 has a threaded rod 80 secured to the middle thereof and threaded into the rear of the remainder of the latch member 62 and held in place by a lock nut 82. Thus the block 64 and cross pin 66 may each be replaced when worn and the length of the latch member 62 may be adjusted to ensure that the cross pin 66 enters the notches 70.

A control handle 84 includes a fore-and-aft extending section 86 having its rear end coupled to the latch member 62 by a ball and socket connector 88. The handle 84 includes a section 90 which joins the forward end of the section 86 and projects upwardly through an L-shaped guide slot 92 located in a top wall of a control console 94. The guide slot 92 is arranged to have a forward transverse leg in which the handle section 90 is held by a tension spring 94 when the handle 84 is holding the member 62 in a latched position, as shown. The member 62 may be moved to an unlock position by moving the lever sideways to and then rearwardly in a fore-and-aft extending portion of the guide slot 92.

The operation of the lock mechanism 44 is as follows: Assuming the backhoe to be readied for transport by the tractor 12, the swing frame 28 will be centered, the boom 32 will be in its raised transport position and the latch member 62 will be in its latched position with the locking block 64 disposed between the stop blocks 52 and 54 and the notch 50 and with the cross pin 66 received in the notches 70 of the hook structure, all as illustrated in the drawing.

Should any side forces then occur which tend to rotate the swing frame 28 about the pivot assembly 30, these forces will be absorbed at the interface of the block 64 first with one or the other of the blocks 52 and 54 and then the forward end of the swing frame plate 48 when the member 62 has moved sideways, as permitted by the tolerance at the pivot pin 60.

The latch member 62 may be released once the tractor backhoe 10 has reached a desired work site by merely moving the handle 84 sideways in the guide slot 92 to the fore-and-aft extending portion thereof and then pushing rearwardly on the handle to effect rotation of the latch member 62 to thereby simultaneously disengage the cross pin 66 from the notches 70 and remove the locking block 64 from between the stop blocks 52 and 54.

I claim:

1. In combination with a backhoe assembly including a support frame, a swing frame, a vertical pivot assembly connecting the swing frame to the support frame for pivotal movement to opposite sides of a centered position, and a backhoe boom vertically pivotally mounted on the swing frame for movement between a raised transport position and selected working positions, a transport latch mechanism for selectively locking the swing frame in its centered position and locking the backhoe boom in its transport position, comprising: an elongate latch member fulcrumed between opposite ends thereof on the swing frame for pivotal movement about a transverse axis between lock and unlock positions and including first and second latching surface means respectively at the opposite ends thereof; third latching surface means integral with the mounting frame; fourth latching surface means integral with the swing frame adjacent the third latching surface means; fifth latching surface means integral with the backhoe boom; said first, third and fourth latching surface means and said second and fifth latching surface means respectively being arranged for interengagement for preventing movement of the swing frame from its centered position and for preventing movement of the boom from its transport position when the latch member is in its lock position.

2. The combination defined in claim 1 wherein the third and fourth latching surface means define a vertically opening channel and the fifth latching surface means define a vertically opening hook structure; said first latching surface means define a block shaped complementary to the channel; and said second latching surface means define a cross-pin shaped complementary to the opening in the hook.

3. The combination defined in claim 2 wherein the hook is defined by a pair of transversely spaced plates having transversely aligned vertically opening notches therein defining the opening in the hook structure.

4. The combination defined in claim 2 wherein the swing frame includes an upper first horizontal plate structure; said support frame including a second horizontal plate structure located directly beneath the first horizontal plate structure; a lug means fixed to and projecting upwardly from the first horizontal plate structure, said latch member being fulcrumed at the lug means; and said channel being formed by a pair of transversely spaced stop bars fixed to and projecting upwardly from the second horizontal plate structure and a fore-and-aft extending notch located in the first horizontal plate.

5. The combination defined in claim 2 wherein the cross pin has a threaded connection with and oriented along the length of the remainder of the latch member whereby the latch member is length adjustable.

6. The combination defined in claim 2 wherein the block is releasably secured to the remainder of the latch member.

7. The combination defined in claim 1 wherein the latch member is length-adjustable between the fulcrum and the second latching surface means.

* * * * *